US010186758B2

(12) United States Patent
Wang et al.

(10) Patent No.: US 10,186,758 B2
(45) Date of Patent: Jan. 22, 2019

(54) ANTENNA SYSTEM AND MOBILE TERMINAL CONTAINING THE SAME

(71) Applicant: AAC Technologies Pte. Ltd., Singapore (SG)

(72) Inventors: Jianan Wang, Shenzhen (CN); Xinying Xu, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/828,550

(22) Filed: Dec. 1, 2017

(65) Prior Publication Data

US 2018/0358698 A1 Dec. 13, 2018

(30) Foreign Application Priority Data

Jun. 9, 2017 (CN) ..... 2017 2 0672294 U

(51) Int. Cl.

| | |
|---|---|
| ***H01Q 1/24*** | (2006.01) |
| ***H01Q 5/335*** | (2015.01) |
| ***H01Q 5/328*** | (2015.01) |
| ***H01Q 1/38*** | (2006.01) |
| ***H01Q 1/48*** | (2006.01) |
| *H01Q 5/10* | (2015.01) |

(52) U.S. Cl.

CPC ..... *H01Q 1/243* (2013.01); *H01Q 1/24* (2013.01); *H01Q 1/38* (2013.01); *H01Q 1/48* (2013.01); *H01Q 5/328* (2015.01); *H01Q 5/335* (2015.01); *H01Q 5/10* (2015.01)

(58) Field of Classification Search

CPC ..... H01Q 1/24; H01Q 1/243; H01Q 5/335; H01Q 1/38; H01Q 1/48; H01Q 5/10; H01Q 5/328; H01Q 1/2266; H01Q 1/2258

See application file for complete search history.

(56) References Cited

U.S. PATENT DOCUMENTS

| | | | | |
|---|---|---|---|---|
| 7,973,726 | B2 * | 7/2011 | Tseng | H01Q 1/243 343/700 MS |
| 9,002,262 | B1 * | 4/2015 | Kuo | H01Q 1/50 343/702 |
| 2005/0001769 | A1 * | 1/2005 | Qi | H01Q 1/243 343/700 MS |
| 2008/0129644 | A1 * | 6/2008 | Seo | H01Q 1/243 343/893 |

(Continued)

*Primary Examiner* — Dameon E Levi
*Assistant Examiner* — Ab Salam Alkassim, Jr.
(74) *Attorney, Agent, or Firm* — Na Xu; IPro, PLLC

(57) ABSTRACT

The present disclosure relates to an antenna system and a mobile terminal containing the same. The antenna system includes a system ground, a metal frame surrounding the system ground without slit and in closed circle shape, a first radiation unit, a second radiation unit and a third radiation unit. The system ground is electrically connected with the metal frame; the first radiation unit comprises a tuning switch connected with the system ground, a first metal wiring connected with the tuning switch, and a second metal wiring connecting the first metal wiring to the metal frame; the second radiation unit comprises a feeding point and a third metal wiring connected with the feeding point, and the third metal wiring at least partially faces the first metal wiring; the third radiation unit comprises a grounding point connected with the system ground and a fourth metal wiring connected with the grounding point.

10 Claims, 5 Drawing Sheets

(56) References Cited

U.S. PATENT DOCUMENTS

| | | | | |
|---|---|---|---|---|
| 2011/0032165 | A1* | 2/2011 | Heng | H01Q 7/005 343/745 |
| 2014/0320349 | A1* | 10/2014 | Lee | H01Q 1/243 343/700 MS |
| 2015/0070239 | A1* | 3/2015 | Hung | H01Q 1/48 343/848 |
| 2016/0028150 | A1* | 1/2016 | Chou | H01Q 1/243 343/702 |
| 2016/0043467 | A1* | 2/2016 | Desclos | H01Q 5/328 343/745 |
| 2016/0204499 | A1* | 7/2016 | Toh | H01Q 1/24 343/702 |
| 2016/0329627 | A1* | 11/2016 | Hong | H01Q 1/243 |
| 2017/0047641 | A1* | 2/2017 | Kim | H01Q 1/243 |
| 2018/0026332 | A1* | 1/2018 | Lin | H01Q 1/243 343/872 |
| 2018/0026334 | A1* | 1/2018 | Chen | H01Q 1/243 343/702 |
| 2018/0026336 | A1* | 1/2018 | Chen | H01Q 1/243 343/702 |
| 2018/0277951 | A1* | 9/2018 | Nishikawa | H01Q 5/307 |

* cited by examiner

ANTENNA SYSTEM AND MOBILE TERMINAL CONTAINING THE SAME

TECHNICAL FIELD

The present disclosure relates to the field of communication technologies and, particularly, relates to an antenna system and a mobile terminal containing the antenna system.

BACKGROUND

Currently, a communication device, such as mobile phone, having a metal housing, has become a mainstream structure of the mobile phones of various brands. When designing the antenna of the mobile phones, a slit is usually defined in a metal frame of the metal housing, for meeting performance of antenna bands. However, if a width of the slit is too great, a structural strength and a visual quality of the whole mobile phone will be influenced; and if the width of the slit is too small, opposite portions beside the slit will be coupled to each other; and the smaller the width of the slit, the stronger the coupling of the opposite portions beside the slit, which seriously influences an antenna performance. Apparently, it is difficult for the metal housing with such slit to simultaneously meet requirements on the structural strength, the visual quality, and the antenna performance.

BRIEF DESCRIPTION OF DRAWINGS

Many aspects of the exemplary embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

Figure 1:
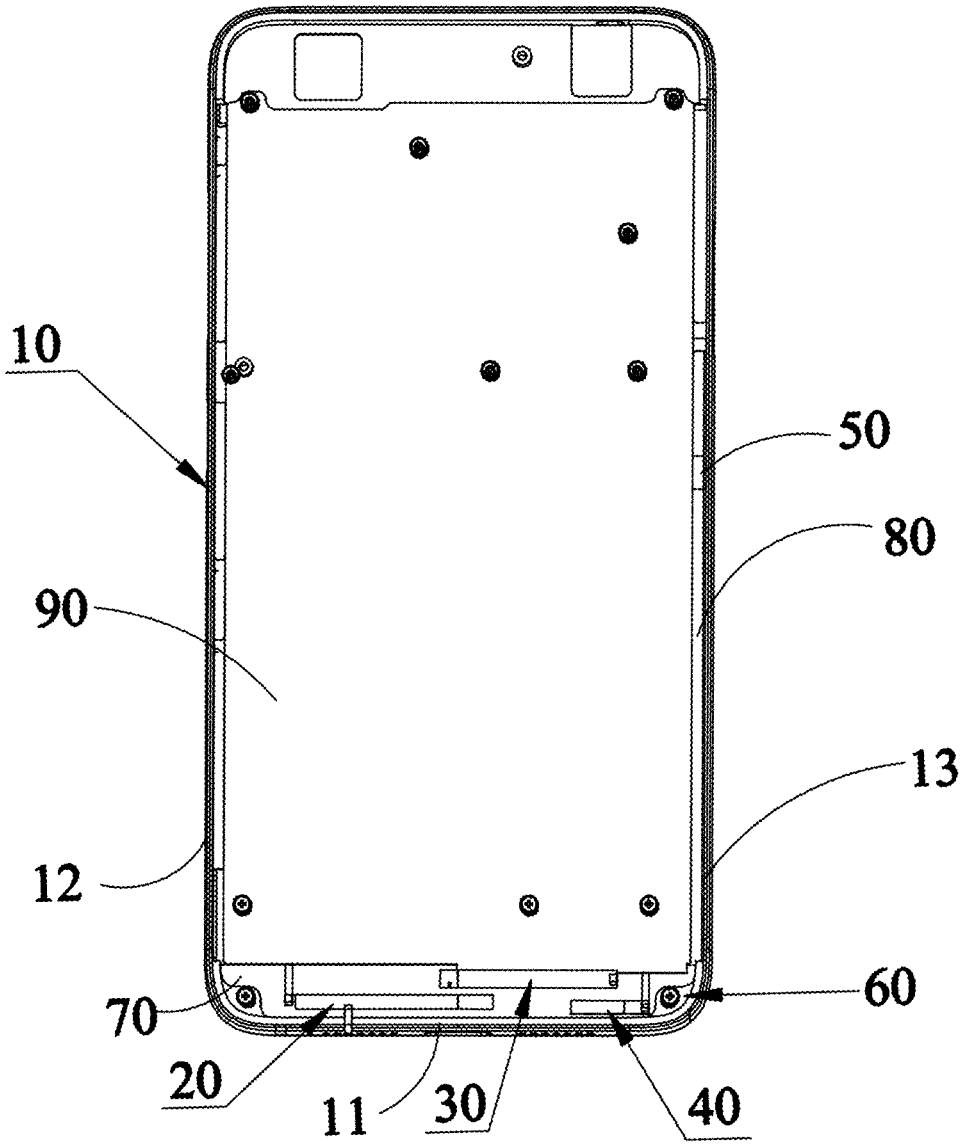
FIG. 1 is a structural schematic diagram of an antenna system according to an embodiment of the present disclosure.

The above-mentioned drawings as a part of the specification are incorporated herein into the specification, which show the embodiments according to the present disclosure, and are used for illustrating a principle of the present application.

DESCRIPTION OF EMBODIMENTS

The present application will be described in detail below by the following embodiments with reference to the accompanying drawings.

As shown in FIGS. 1-5, the embodiment of the present disclosure provides a mobile terminal, such as mobile phone. The mobile terminal includes an antenna system.

Specifically, the antenna system includes a system ground 90, a metal frame 10 surrounding the system ground 90, a first radiation unit 20, a second radiation unit 30, and a third radiation unit 40. The metal frame 10 is shaped in a closed circle without a slit. As shown in FIGS. 1, 2, 4, and 5, the metal frame 10 is annular and has no slit along a circumferential direction thereof.

Generally, the antenna system further includes a circuit board. The system ground 90 can be a metal layer placed on the circuit board. The system ground 90 is electrically connected with the metal frame 10, for grounding the metal frame 10.

The first radiation unit 20 includes a tuning switch 21 connected with the system ground 90, a first metal wiring 23 connected with the tuning switch 21, and a second metal wiring 22 connecting the first metal wiring 23 to the metal frame 10. One end of the second metal wiring 22 is connected between the tuning switch 21 and a distal end of the first metal wiring 23 (the distal end of the first metal wiring 23 refers to an end away from the tuning switch 21), and the other end of the second metal wiring 22 is connected with the metal frame 10, for electrically connecting the first radiation unit 20 with the metal frame 10 to form a first antenna.

The second radiation unit 30 includes a feeding point 32 and a third metal wiring 31 connected with the feeding point 32. The third metal wiring 31 is spaced from the first metal wiring 23, and at least partially faces the first metal wiring 23. That is to say, along a direction perpendicular to the first metal wiring 23, a projection of the first metal wiring 23 at least partially overlaps with a projection of the third metal wiring 31. Generally, a portion of the first metal wiring 23 close to the distal end partially faces a portion of the third metal wiring 31 away from the feeding point 32, so that the second radiation unit 30 is coupled to the first radiation unit 20 to form a second antenna.

The third radiation unit 40 includes a grounding point 42 connected with the system ground 90 and a fourth metal wiring 41 connected with the grounding point 42. The fourth metal wiring 41 is spaced from the metal frame 10, and at least partially faces the bottom frame 11. That is to say, along a direction perpendicular to an extending direction of the fourth metal wiring 41, a projection of the fourth metal wiring 41 at least partially overlaps with a projection of the bottom frame 11, so that the third radiation unit 40 is coupled to the metal frame 10 to form a third antenna.

In the above-described antenna system, the first antenna is formed by connecting the first radiation unit 20 with the metal frame 10, the second antenna is formed by coupling the second radiation unit 30 to the first radiation unit 20, and the third antenna is formed by coupling the third radiation unit 40 to the metal frame 10, so that a radiation of the antenna system is realized. In such antenna system, no slit is required to be defined in the metal frame 10, and the metal frame 10 is shaped in a closed circle, so that a structural strength of the whole mobile terminal is improved, and a cosmetic defect caused by a slit of the metal frame in prior art is avoided. In addition, it is unnecessary to accurately match with the slit in size, so that the tolerance control range decreases while the production cost and hour decreases, which improves good yield of the products.

Figure 2:
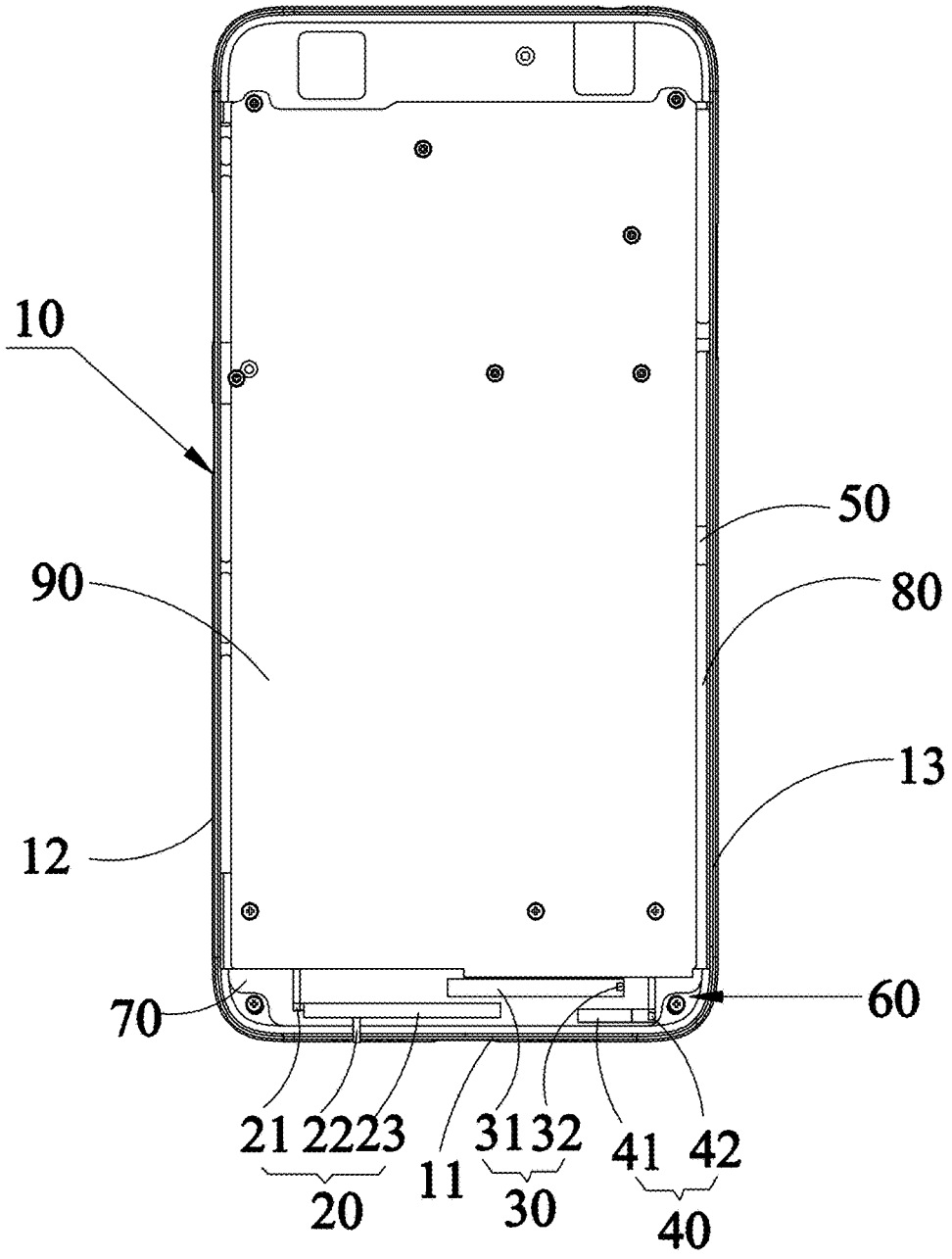
FIG. 2 is a front view of an antenna system according to an embodiment of the present disclosure.
Figure 3:
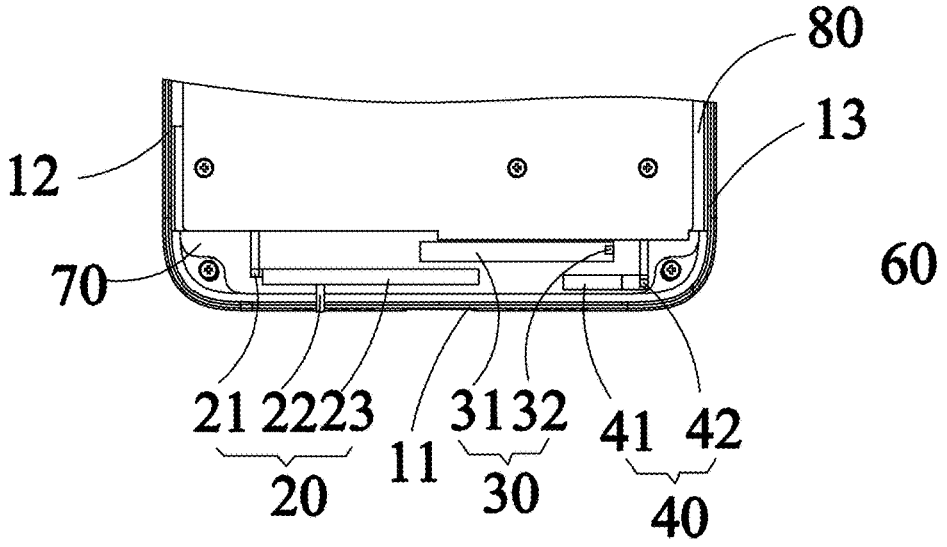
FIG. 3 is a partial, structural schematic diagram of an antenna system according to an embodiment of the present disclosure.
Figure 4:
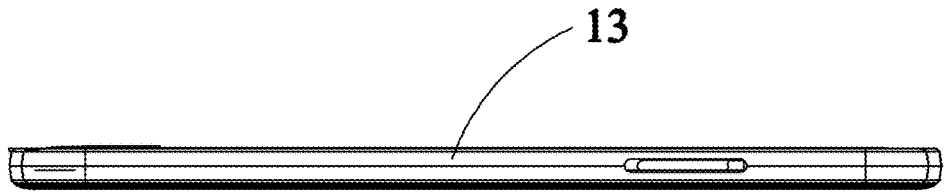
FIG. 4 is a bottom view of an antenna system according to an embodiment of the present disclosure.
Figure 5:
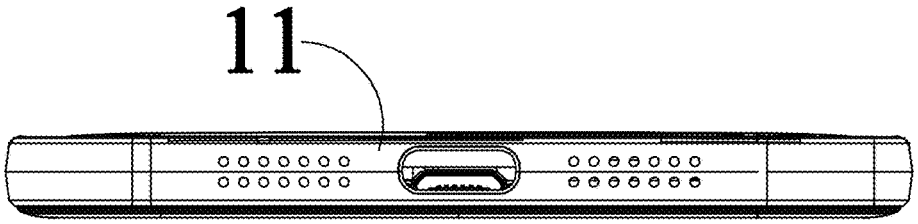
FIG. 5 is a side view of an antenna system according to an embodiment of the present disclosure.

A quantity of connecting position of the system ground 90 and the metal frame 10 can be one, two, or more. Optionally, as shown in FIGS. 2 and 3, the metal frame 10 can include a bottom frame 11, a first side frame 12, and a second side frame 13. The first side frame 12 and the second side frame 13 are placed on opposite ends of the bottom frame 11, respectively. The system ground 90 is connected with the second side frame 12, directly or indirectly. The fourth metal wiring 41 is parallel to the bottom frame 11. Generally, an edge portion of the system ground 90 is directly connected with the second side frame 13, for ensuring the ground stability of the metal frame 10 and the system ground 90.

Since the first metal wiring 23, the second metal wiring 22, the third metal wiring 31, and the fourth metal wiring 41 are flexible circuit boards, or made by a laser direct structuring method, the antenna system further includes a bracket 70. The bracket 70 is made of a non-metal material, for example, the bracket 70 is a plastic member. A clearance area 60 is defined between the system ground 90 and the metal frame 10. The first radiation unit 20, the second radiation unit 30, and the third radiation unit 40 are placed in the clearance area 60 by the bracket 70, so that the first radiation unit 20, the second radiation unit 30, and the third radiation unit 40 are supported by the non-metal bracket 70 to facilitate installation of the antenna system in the mobile terminal.

For improving the antenna bandwidth and the radiation efficiency, as shown in FIG. 2, a gap 80 is defined between the second side frame 13 and the system ground 90, and the gap 80 is communicated with the clearance area 60, so that the radiation efficiency of the antenna is greatly improved while the antenna bandwidth, especially low frequency bandwidth, is improved. Furthermore, a gap 80 can be also defined between the first side frame 12 and the system ground 90.

As further shown in FIG. 2, the antenna system may further include a connection member 50. The system ground 90 is connected with the second side frame 13 by the connection member 50, and the connection member 50 is placed in the gap 80, so that the second side frame 13 is grounded by the connection member 50, and then the ground stability of the metal frame 10 is ensured.

Optionally, a resistance of the connection member 50 is 0Ω, so as to decrease the energy loss between the system ground 90 and the metal frame 10 as much as possible.

It is noted that the antenna system may further include an elastic piece. The connections between the second metal wiring 22 and the metal frame 10 and between the fourth metal wiring 41 and the metal frame 10 can be realized by the elastic piece. In a manufacturing and assembling process for the antenna system, there are some errors more or less. By the elastic piece, the elastic stroke of the elastic piece is capable of compensating the errors in the manufacturing and assembling process, thereby ensuring the connection reliability of those metal wirings and the metal frame 10.

Optionally, extending directions of the first metal wiring 23, the third metal wiring 31, and the fourth metal wiring 41 are parallel to each other and the bottom frame 11, and the extending direction of the second metal wiring 22 is perpendicular to the bottom frame 11. By such arrangement, while ensuring that the above-described metal wirings face the bottom frame 11, the space occupancy of the first radiation unit 20, the second radiation unit 30, and the third radiation unit 40 can be decreased as far as possible, thereby facilitating the structural arrangement of the mobile terminal.

Generally, the first metal wiring 23 and the fourth metal wiring 41 are placed between the third metal wiring 31 and the bottom frame 11. For ensuring the coupling effect of the first metal wiring 23 to the third metal wiring 31, in a direction perpendicular to the first metal wiring 23, a distance between the first metal wiring 23 and the third metal wiring 31 is smaller than a distance between the fourth metal wiring 41 and the third metal wiring 31. That is to say, the first metal wiring 23 is closer to the third metal wiring 31 than the fourth metal wiring 41 is, so that interference from the fourth metal wiring 41 is avoided while the coupling of the first metal wiring 23 to third metal wiring 31 is ensured.

Similarly, for ensuring the coupling effect of the fourth metal wiring 41 to the metal frame 10, in a direction perpendicular to the fourth metal wiring 41, a distance between the fourth metal wiring 41 and the metal frame 10 is smaller than a distance between the fourth metal wiring 41 and the third metal wiring 31. That is to say, the fourth metal wiring 41 is closer to the metal frame 10 than the third metal wiring 31 is.

Furthermore, the tuning switch 21 has an open circuit state, a first capacitor access state, a second capacitor access state, and an inductor access state. When the tuning switch 21 is in the open circuit state, the first metal wiring 23 is disconnected from the system ground 90; when the tuning switch is in the first capacitor access state, the first metal wiring 23 is connected with the system ground 90 by a first capacitor member; when the tuning switch 21 is in the second capacitor access state, the first metal wiring 23 is connected with the system ground 90 by a second capacitor member; and when the tuning switch 21 is in the inductor access state, the tuning switch 21 is connected with the system ground 90 by an inductor member. A capacitance of the first capacitor member can be in a range of 1.8 PF-2.3 PF, a capacitance of the second capacitor member can be in a range of 0.2 PF-0.6 PF, and an inductance of the inductor member can be in a range of 3 NH-6 NH. The capacitances of the first capacitor member and the second capacitor member and the inductance of the inductor member can be specifically selected according to frequency bands and the bandwidth of the antenna to be tuned.

In the above-described embodiments, radiators of the first antenna includes the first metal wiring 23, the second metal wiring 22, and a portion of the metal frame 10 extending from a junction of the second metal wiring 22 and the metal frame 10 to the connection member 50, passing the second side frame 13 and without passing the first side frame 12. The working frequency band of the first antenna is 704 MHZ-960 MHZ.

Radiator of the second antenna mainly includes the third metal wiring 31 in itself. The working frequency band of the second antenna is 1710 MHZ-2170 MHZ.

Radiators of the third antenna mainly includes the fourth metal wiring 41 and a coupling radiation portion between the fourth metal wiring 41 and the bottom frame 11. The working frequency band of the third antenna is 2300 MHZ-2690 MHZ.

Figure 6:
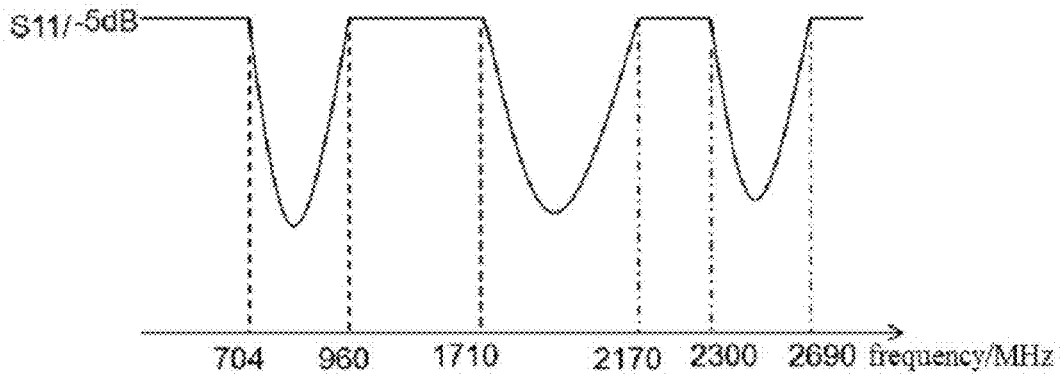
FIG. 6 is a return-loss plot of an antenna system according to an embodiment of the present disclosure.
Figure 7:
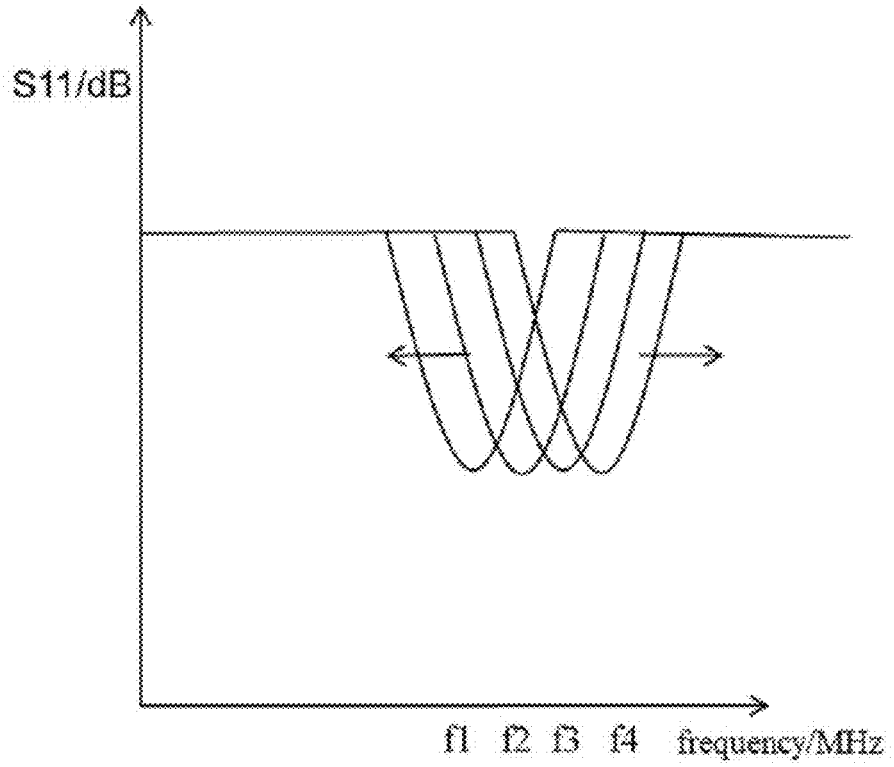
FIG. 7 is a return-loss plot of an antenna system according to an embodiment of the present disclosure, wherein a tuning switch of a first antenna is at different states.
Figure 8:
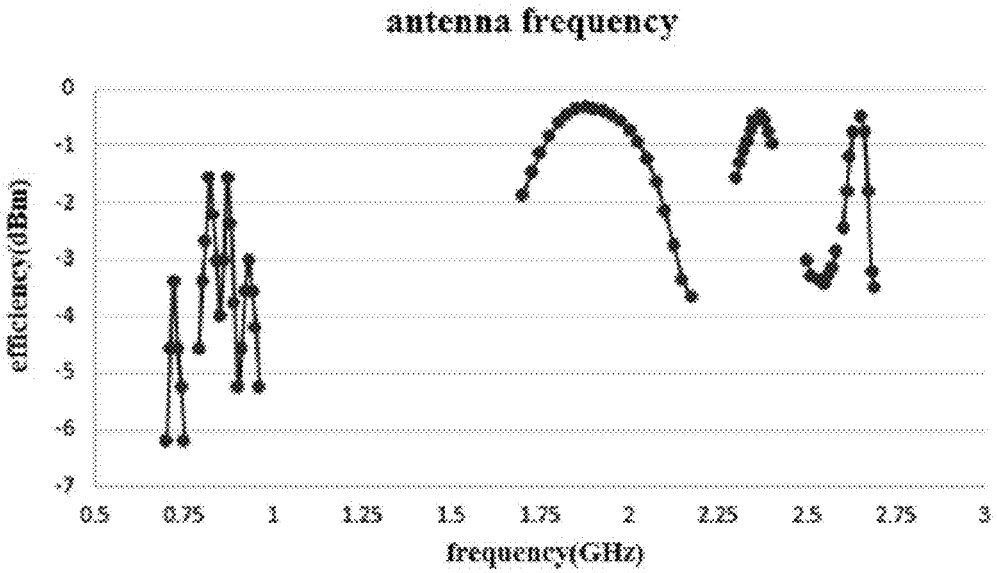
FIG. 8 is a radiation efficiency diagram of an antenna system according to an embodiment of the present disclosure.

Reflection coefficient curves of the first antenna, the second antenna, and the third antenna obtained in the antenna system of the present disclosure are shown in FIG. 6. By tuning states of the tuning switch 21, the bandwidth of the working frequency band of the first antenna can be adjusted. As shown in FIG. 7, the frequency bands from right to left correspond to the open circuit state, the first capacitor access state, the second capacitor access state, and the inductor access state of the tuning switch 21, respectively. In FIGS. 6 and 7, S11 refers to the reflection coefficient. The radiation efficiency graphs of the first antenna, the second antenna and the third antenna are shown in FIG. 8, wherein for the first antenna, the radiation efficiencies from right to left correspond to the open circuit state, the first capacitor access state, the second capacitor access state and the inductor access state of the tuning switch 21, respectively.

The embodiments described above are merely preferred embodiments of the present application and they do not limit the present application. Those skilled in the art can make various modifications and changes to the present disclosure. However, any modification, equivalent replacement, and improvement made within the spirit and principle of the present disclosure shall fall within the scope of the present application.

What is claimed is:

1. An antenna system, comprising:

a system ground;

a metal frame surrounding the system ground and electrically connected with the system ground, wherein the metal frame is shaped in a closed loop without a slit;

a first radiation unit comprising a tuning switch, a first metal wiring and a second metal wiring;

a second radiation unit comprising a feeding point and a third metal wiring connected with the feeding point; and a third radiation unit comprising a grounding point connected with the system ground and a fourth metal wiring connected with the grounding point; wherein the tuning switch is connected with the system ground, the first metal wiring is connected with the tuning switch, and the second metal wiring connects the first metal wiring with the metal frame; one end of the second metal wiring is connected between the tuning switch and a distal end of the first metal wiring, and the other end of the second metal wiring is connected with the metal frame, for electrically connecting the first radiation unit with the metal frame to form a first antenna;

the third metal wiring is spaced from the first metal wiring, and at least partially faces the first metal wiring, so that the second radiation unit is coupled to the first radiation unit to form a second antenna; and the fourth metal wiring is spaced from the metal frame, so that the third radiation unit is coupled to the metal frame to form a third antenna.

2. The antenna system as described in claim 1, wherein in a direction perpendicular to the first metal wiring, a distance between the first metal wiring and the third metal wiring is smaller than a distance between the fourth metal wiring and the third metal wiring.

3. The antenna system as described in claim 1, wherein the metal frame comprises a bottom frame, a first side frame and a second side frame, the first side frame and the second side frame are placed on opposite ends of the metal frame, respectively;

the system ground is connected with the second side frame, and the fourth metal wiring is parallel to the bottom frame.

4. The antenna system as described in claim 3, further comprising a bracket made of a non-metal material, a clearance area is defined between the system ground and the metal frame, and the first radiation unit, the second radiation unit and the third radiation unit are placed in the clearance area by the bracket.

5. The antenna system as described in claim 4, wherein a gap is defined between the second side frame and the system ground, and the gap is communicated with the clearance area.

6. The antenna system as described in claim 5, further comprising a connection member, the system ground is connected with the second side frame by the connection member, and the connection member is placed in the gap.

7. The antenna system as described in claim 6, wherein a resistance of the connection member is 0Ω.

8. The antenna system as described in claim 1, wherein the tuning switch has an open circuit state, a first capacitor access state, a second capacitor access state and an inductor access state;

when the tuning switch is in the open circuit state, the first metal wiring is disconnected from the system ground;

when the tuning switch is in the first capacitor access state, the first metal wiring is connected with the system ground by a first capacitor member;

when the tuning switch is in the second capacitor access state, the first metal wiring is connected with the system ground by a second capacitor member; and when the tuning switch is in the inductor access state, the tuning switch is connected with the system ground by an inductor member.

9. The antenna system as described in claim 1, wherein a working frequency band of the first antenna is 704 MHZ-960 MHZ, a working frequency band of the second antenna is in 1710 MHZ-2170 MHZ, and a working frequency band of the third antenna is 2300 MHZ-2690 MHZ.

10. A mobile terminal, comprising the antenna system as described in claim 1.

* * * * *